US005489129A

United States Patent [19]

Shepherd

[11] Patent Number: 5,489,129

[45] Date of Patent: Feb. 6, 1996

[54] DOOR LOCK

[75] Inventor: Charles G. Shepherd, Oakville, Canada

[73] Assignee: Meranto Technology Inc., Toronto, Canada

[21] Appl. No.: 277,055

[22] Filed: Jul. 19, 1994

[51] Int. Cl.[6] ..... E05C 5/00

[52] U.S. Cl. ..... 292/63; 292/67

[58] Field of Search ..... 292/63, 67, 290, 292/294, DIG. 19, 298

[56] References Cited

U.S. PATENT DOCUMENTS

| | | | |
|---|---|---|---|
| Re. 29,162 | 3/1977 | McLennan | 292/290 X |
| 406,588 | 7/1889 | Millemann et al. | 292/67 |
| 1,542,468 | 6/1925 | Mueller | 292/67 |
| 1,575,071 | 3/1926 | Luman | 292/67 X |
| 1,675,579 | 7/1928 | Seng | 292/63 X |
| 2,067,779 | 1/1937 | Morden | 292/67 |
| 4,322,100 | 3/1982 | McLennan et al. | 292/67 |
| 4,865,369 | 9/1989 | Parker | 292/291 |

*Primary Examiner*—Rodney M. Lindsey
*Attorney, Agent, or Firm*—Rogers & Sott

[57] ABSTRACT

A door lock has a body portion securable to a door jamb so as to project therefrom into a room, and a locking portion pivotally mounted on the body portion for angular movement relative thereto about a vertical axis between a locking position preventing opening of a door and an unlocking position permitting opening of the door. One of the portions has a projection engageable in a recess in the other portion to retain the locking portion in the locking position. The locking portion is capable of a limited amount of transverse movement relative to the body portion in a horizontal direction substantially perpendicular to the direction of opening movement of the door to enable the projection to be engaged in and disengaged from the recess.

7 Claims, 3 Drawing Sheets

DOOR LOCK

FIELD OF THE INVENTION

This invention relates to door locks.

1. Background of the Invention

Many attempts have been made in the past to provide a door lock which can be operated by a person within a room and which cannot be tampered with by a person outside the room. Such door locks must not only provide reasonable security for the person in the room but must also be capable of easy operation.

2. Description of the Prior Art

Known door locks of this kind may be portable, i.e. can be carried around by a person and used when required, or may be permanently secured to a door jamb. Some known door locks are capable of use in either manner, i.e. portable or permanently secured. However, although many different door locks of this general kind have been proposed, there is still a need for a door lock which is easily operable and provides a reasonable amount of security.

It is therefore an object of the invention to provide an improved door lock of this kind.

SUMMARY OF THE INVENTION

The present invention provides a door lock comprising a body portion securable to a door jamb so as to project therefrom into a room, and a locking portion pivotally mounted on the body portion for angular movement relative thereto about a vertical axis between a locking position preventing opening of a door and an unlocking position permitting opening of the door. One of the portions has a projection engageable in a recess in the other portion to retain the locking portion in a locking position. The locking portion is capable of a limited amount of transverse movement relative to the body portion in a horizontal direction substantially perpendicular to the direction of opening movement of the door to enable the projection to be engaged in and disengaged from the recess.

The projection may be on the locking portion and the recess in the body portion.

The door lock may also include a resilient member acting between the body portion and the locking portion to resiliently urge the locking portion in the horizontal direction in a projection-engaging direction. The locking portion may be pivotally mounted on the body portion by means of a pin and slot connection with the resilient member acting on the pin in the slot. The pin may be located on the locking portion and the slot located in the body portion.

The locking portion may have an upper pin extending downwardly into a horizontally-elongated slot in the body portion and a lower pin extending upwardly into a horizontally-elongated slot in the body portion to provide the pin and slot connection, the body portion also having an upper horizontal bore containing a resilient member acting between the body portion and the upper pin and a lower horizontal bore containing a further resilient member acting between the body portion and the lower pin.

BRIEF DESCRIPTION OF THE DRAWING

One embodiment of the invention will now be described, by way of example, with reference to the accompanying drawings, of which.

DESCRIPTION OF THE PREFERRED EMBODIMENT

Figure 1:
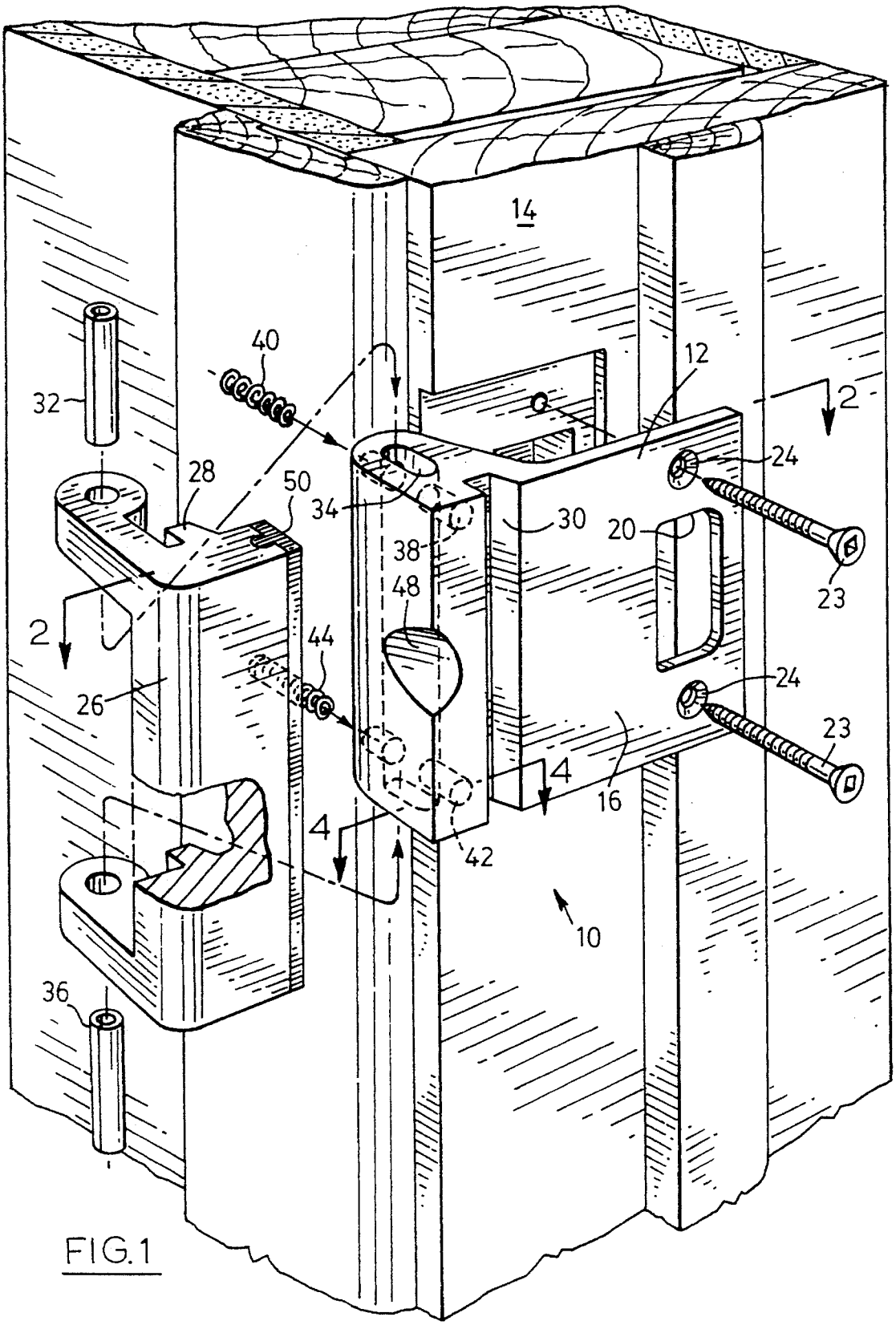
FIG. 1 is an exploded perspective view of a door lock in accordance with the invention secured to a door jamb.

Referring to the drawings, a door lock 10 comprises a body portion 12 secured to a door jamb 14 so as to project therefrom into a room. The body portion 12 has a rearwardly projecting plate-like part 16 extending between the door jamb 14 and a door 18. In this embodiment, the plate-like part 16 replaces a convention striker plate and has an aperture 20 to receive a conventional door catch 22, the plate-like part being secured to the door jamb 14 by two screws 23 which pass through a hole 24 in the plate-like part 16 in a conventional manner.

A locking portion 26 is pivotally mounted on the body portion 12 for angular movement relative thereto about a vertical axis, as indicated by arrow A, between a locking position (shown in full lines) preventing opening of the door 18 and an unlocking position (shown in dotted lines) permitting opening of the door 18. The locking portion 26 has a projection 28 which engages in a recess 30 in the body portion 12 when the locking portion 26 is in the locking position. Both the projection 28 and the recess 30 extend for the full height of the locking portion 26 and the body portion 12 respectively.

The locking portion 26 has an upper pin 32 extending downwardly into a horizontally extending slot 34 which extends through the body portion 12 from top to bottom thereof, and a lower pin 36 extending upwardly into the slot 34. The body portion 12 has an upper horizontal bore 38 containing a first spring 40 which acts between the body portion 12 and the upper pin 32 of the locking portion 26, and a lower horizontal bore 22 containing a second spring 44 which acts between the body portion 12 and the lower pin 36. The slot 34 is horizontally elongated so that it provides pin and slot connections for the upper and lower pins 32, 36. The pins 32, 36 are therefore capable of a limited amount of horizontal movement in the slot 34, with the springs 40, 44 urging the pins 32, 36 in a direction which causes the projection 28 on the locking portion 26 to engage firmly in the recess in the body portion 12.

Figure 2:
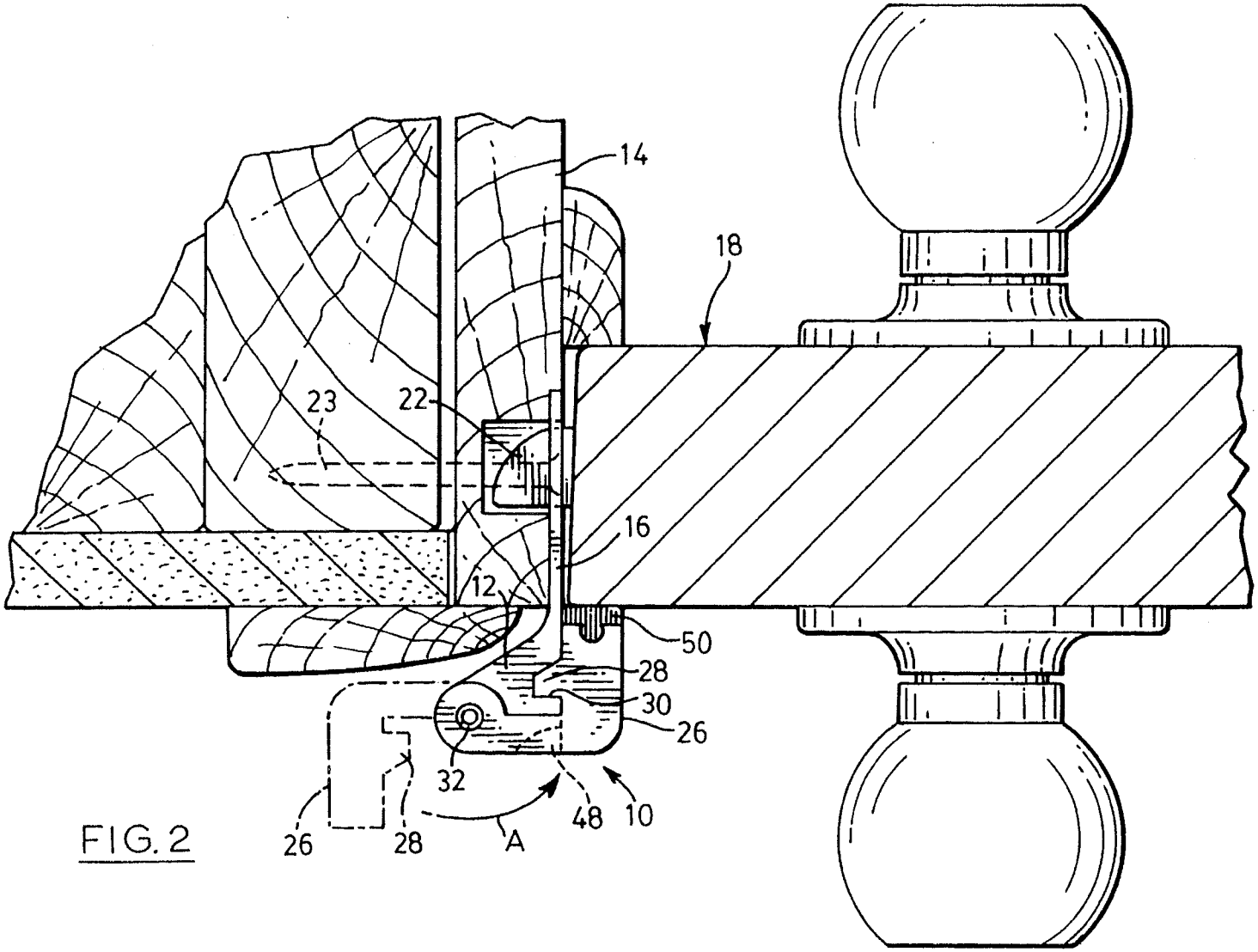
FIG. 2 is a sectional view along the line 2—2 of FIG. 1 and also showing a door.
Figure 3:
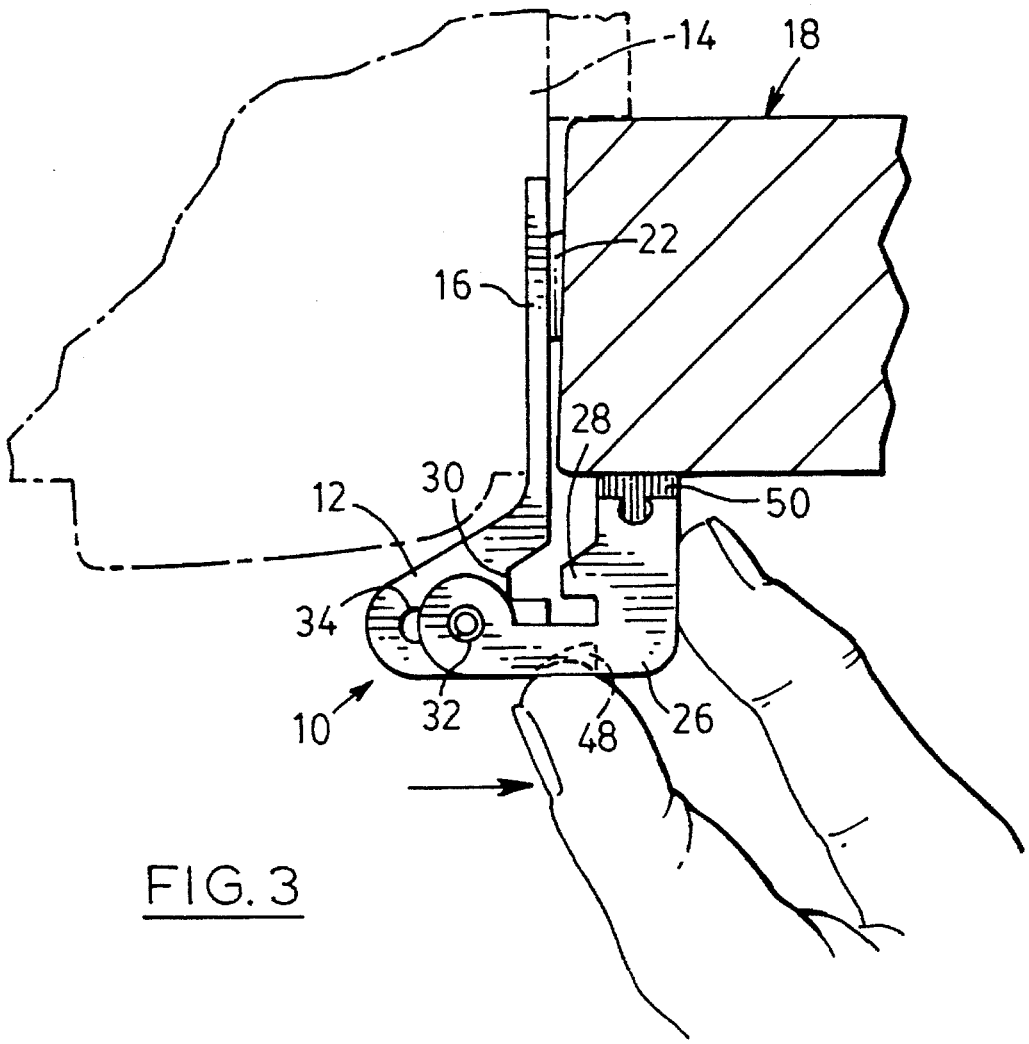
FIG. 3 is a plan view of the door lock secured to a door jamb and showing horizontal movement of the locking portion to release the projection from the recess.
Figure 4:
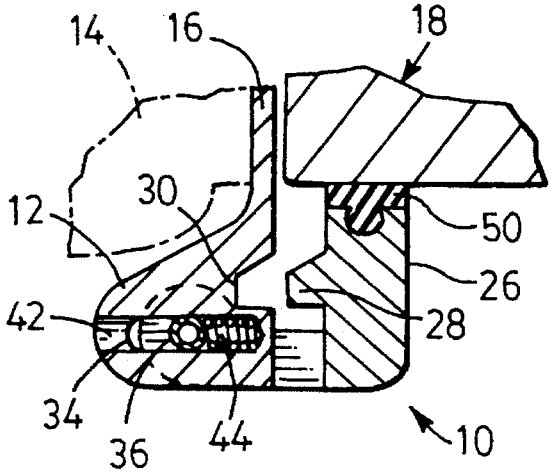
FIG. 4 is a sectional view along the line 4—4 of FIG. 1.

In use, the body portion 12 is secured to the door jamb 14 as previously described. When the door 18 is closed and the locking portion 26 is in the unlocking position clear of the door 18, as shown in dotted outline in FIG. 2, the door lock 10 is operated by a person in the room by swinging the locking portion 26 about a vertical axis defined by the pins 32, 36 towards the door 18 as indicated by the arrow A in FIG. 2. When nearly in the locking position as shown in FIG. 3, the person pulls the locking portion 26 a limited distance in a horizontal direction away from the body portion 12, with the pins 32, 36 moving in the slot 34 against the action of the springs 40, 44, to enable the projection 28 on the locking portion 26 to enter the recess 30 in the body portion 12. The front end of the body portion 12 has a depression 48 adjacent the locking portion 26 to facilitate gripping of the locking portion 26 by the person actuating the door lock.

When the projection 28 has entered the recess 30, the person releases the locking portion 26 so that the springs 40, 44 urge the pins 32, 36 towards their previous positions in the slot 34, thereby firmly engaging the projection 28 in the recess 30 and causing the body portion 26 to prevent opening of the door 18. If desired, the body portion 26 may have a protective pad 50 at the end engaging the door 18. Release of the door lock 10 can of course be effected by simply reversing the locking procedure.

It will be noted that the projection 28 and the recess 30 are located, when the projection 28 is engaged in the recess 30, on the same side of the vertical pivot axis defined by the pins 32, 36 as the door 18.

The ease of installation, operation and security afforded by a door lock in accordance with the present invention will be readily apparent to a person skilled in the art from the foregoing description of a preferred embodiment. It will also be apparent that the body portion may alternatively be secured to a portion of the door jamb remote from a conventional striker plate or may be releasably secured to the door jamb by provision of a projection engageable in the aperture of a conventional striker plate in a manner known in the art. Also, if desired, the projection 28 may alternatively be provided on the body portion 12, with the recess 30 being correspondingly provided on the locking portion 26 instead of on the body portion 12.

Other embodiments will also be readily apparent to a person skilled in the art, the scope of the invention being defined in the appended claims.

I claim:

1. A door lock comprising:

a body portion securable to a door jamb so as to project therefrom into a room, and a locking portion pivotally mounted on the body portion for angular movement relative thereto about a vertical pivot axis, when the body portion is secured to the door jamb, between a locking position engaging and preventing opening of a door and an unlocking position permitting opening of the door, one of said portions having a projection engageable in a recess in the other portion to retain the locking portion in the locking position, and said locking portion being capable of a limited amount of transverse movement relative to the body portion in a horizontal direction substantially perpendicular to the direction of opening movement of the door to enable the projection to be engaged in and a plane through the vertical pivot axis and perpendicular to the door, when closed, establishing the door on one side of the plane said projection and said recess being located, when said projection is engaged in said recess, on the same side of said plane through said vertical pivot axis as the door.

2. A door lock according to claim 1 wherein the projection is on the locking portion and the recess is in the body portion.

3. A door lock according to claim 1 also including a resilient member acting between the body portion and the locking portion to resiliently urge the locking portion in said horizontal direction in a projection-engaging direction.

4. A door lock according to claim 3 wherein the locking portion is pivotally mounted on the body portion by means of a pin and slot connection and the resilient member acts on the pin in the slot.

5. A door lock according to claim 4 wherein the pin is located on the locking portion and the slot is located in the body portion.

6. A door lock according to claim 4 wherein the locking portion has an upper pin extending downwardly into a horizontally-extending elongated slot in the body portion and a lower pin extending upwardly into a horizontally-elongated slot in the body portion to provide said pin and slot connection, the body portion also having an upper horizontal bore containing a said resilient member acting between the body portion and the upper pin and a lower horizontal bore containing a said resilient member acting between the body portion and the lower pin.

7. A door lock according to claim 1 wherein the body portion is securable to a door jamb in place of a conventional striker plate.

* * * * *

UNITED STATES PATENT AND TRADEMARK OFFICE

CERTIFICATE OF CORRECTION

PATENT NO. : 5,489,129
DATED : February 6, 1996
INVENTOR(S) : Charles G. Shepherd It is certified that error appears in the above-identified patent and that said Letters Patent is hereby corrected as shown below:

Column 4, line 5, after "and" insert --disengaged from the recess,--.

Signed and Sealed this

Eighth Day of October, 1996

*Attest:*

Bruce Lehman

BRUCE LEHMAN

*Attesting Officer*

*Commissioner of Patents and Trademarks*